US007456719B2

(12) United States Patent
Suzuki et al.

(10) Patent No.: US 7,456,719 B2
(45) Date of Patent: Nov. 25, 2008

(54) INVERTER TRANSFORMER

(75) Inventors: Mitsuaki Suzuki, Kitasaku-gun (JP); Koichi Nonoyama, Kitasaku-gun (JP); Yoshinori Arao, Kitasaku-gun (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 11/795,479

(22) PCT Filed: Sep. 4, 2006

(86) PCT No.: PCT/JP2006/317469

§ 371 (c)(1),
(2), (4) Date: Aug. 20, 2007

(87) PCT Pub. No.: WO2007/029651

PCT Pub. Date: Mar. 15, 2007

(65) Prior Publication Data

US 2008/0088403 A1 Apr. 17, 2008

(30) Foreign Application Priority Data

Sep. 5, 2005 (JP) ..... 2005-256227

(51) Int. Cl.
*H01F 27/30* (2006.01)

(52) U.S. Cl. ..... 336/198

(58) Field of Classification Search ..... 336/65, 336/83, 170, 178, 198, 200, 212, 214–215
See application file for complete search history.

(56) References Cited

U.S. PATENT DOCUMENTS 6,894,596 B2 * 5/2005 Suzuki ..... 336/212
2004/0130426 A1 7/2004 Suzuki
2005/0237145 A1 * 10/2005 Fushimi ..... 336/208

FOREIGN PATENT DOCUMENTS

| | | |
|---|---|---|
| JP | A 2-152210 | 6/1990 |
| JP | A 7-297022 | 11/1995 |
| JP | A 7-297023 | 11/1995 |
| JP | A 2001-148318 | 5/2001 |
| JP | A 2002-43148 | 2/2002 |
| JP | A 2002-353044 | 12/2002 |
| JP | A 2004-214488 | 7/2004 |
| JP | A 2005-39050 | 2/2005 |
| WO | WO 2004/109723 A1 | 12/2004 |

* cited by examiner

*Primary Examiner*—Tuyen T. Nguyen
(74) *Attorney, Agent, or Firm*—Oliff & Berridge, PLC

(57) ABSTRACT

An inverter transformer for lighting multiple discharge lamps is provided which has a plurality of output voltages including reversed polarity output voltages while ensuring a reliable insulation performance, and which is produced in a small size and at a low cost. An inverter transformer includes a magnetic core assembly, and a plurality of bobbins each having a primary winding and a secondary winding wound therearound. Adjacent two bobbins of the bobbins constitute either a first bobbin pair which are provided with respective secondary windings at which output voltages having their polarities reversed from each other are induced, or a second bobbin pair. An insulation distance setting means are provided between the two bobbins so that the distance between the secondary windings disposed at the two bobbins and of the first bobbin pair is larger than the distance between the secondary windings disposed at the two bobbins of the second bobbin pair.

4 Claims, 8 Drawing Sheets

INVERTER TRANSFORMER

BACKGROUND OF THE INVENTION

1. Field of the Invention

The present invention relates to an inverter transformer for lighting a discharge lamp as a light source of backlight device for a liquid crystal display apparatus, and particularly to an inverter transformer to provide a plurality of outputs for lighting a plurality of discharge lamps.

2. Description of the Related Art

A liquid crystal display (LCD) apparatus, which is used for electronic appliances, such as a television, a personal computer, and the like, does not emit light by itself, and therefore a lighting system, such as a backlight device, is required. A discharge lamp is used as a light source for such a backlight device, and a cold cathode fluorescent lamp (CCFL) is typically employed as a discharge lamp. Recently, the screen size of an LCD apparatus, for example, an LCD television, is becoming larger and larger, and a plurality of CCFLs are used in order to achieve the high brightness level required. A high voltage is required for lighting a CCFL, and a high frequency voltage generated at a switching portion of an inverter circuit is boosted by an inverter transformer up to a high voltage required for lighting a CCFL.

A typical conventional inverter transformer provides a single output, and for lighting a plurality of CCFLs, inverter transformers must be provided in a number equal to the number of the CCFLs used. Accordingly, a large size LCD apparatus requires a number of inverter transformers thus increasing the size of a backlight device. To deal with this size increase issue, an inverter transformer is disclosed which includes a plurality of secondary windings to thereby provide a plurality of outputs (refer, for example, to Patent Document 1).

FIG. 11 shows such an inverter transformer as disclosed in Patent Document 1. Referring to FIG. 11, an inverter transformer 120 includes a frame magnetic core 121 shaped rectangular, and three I-cores 123*a*, 123*b* and 123*c* arranged inside the frame magnetic core 121. The I-cores 123*a*, 123*b* and 123*c* respectively have primary windings 124*a*, 124*b* and 124*c* and secondary windings 125*a*, 125*b* and 125*c* wound therearound thereby enabling three CCFLs to be lit. In the inverter transformer 120, voltages with an identical polarity are induced at the secondary windings 125 (125*a*/125*b*/125*c*) by a current flowing in the primary windings 124 (124*a*/124*b*/124*c*), and hence no voltage difference exists at the secondary windings 125 thus allowing the withstand voltage to be lowered, which results in downsizing of the inverter transformer 120.

With an increase of an LCD apparatus and a resultant increase of a backlight device, the length dimension of a CCFL as a light source is inevitably increased. A higher voltage is required for starting to light a CCFL with an increased length, and the output voltage at the secondary winding becomes higher thus requiring an increased withstand voltage. Also, in a common connection structure where the low voltage side of the CCFL is provided with a return line, the brightness at the low voltage side of the CCFL tends to easily go down. Further, since a number of wiring materials of a high withstand voltage are required, problems are raised about safety and cost.

To overcome the lowering of the brightness at the low voltage side and to reduce the number of wiring materials of a high withstand voltage, various approaches have been proposed where CCFLs are driven with a double voltage. For example, reverse polarity high voltages having their phases shifted from each other by 180 degrees (opposite phase) are applied respectively to both terminals of a long CCFL or a bent lamp such as a U-shape lamp, or to two CCFLs which have their respective low voltage sides connected to each other. In the approaches described above, in order to apply a reverse polarity high voltage to both terminals of a CCFL, an inverter transformer includes secondary windings to generate high AC voltages independent of each other, and the secondary windings are wound in opposite directions so that the output voltages have their phases shifted from each other by 180 degrees (refer, for example, to Patent Document 2).

FIG. 12 is a top plan view of an inverter transformer disclosed in Patent Document 2, and FIG. 13 is an exploded perspective view of magnetic cores of the inverter transformer of FIG. 12.

An inverter transformer shown in FIG. 12 includes a primary winding 230, and two primary windings 240*a* and 240*b* magnetically coupled to the primary winding 230. Further included in the inverter transformer are magnetic cores 250 and 260 shown in FIG. 13, which are made of a magnetic material. Referring to FIG. 13, the magnetic core 25 includes a rectangular support 251, two columnar supports 252 and 253, and an elongated projection 254 disposed along the length of the rectangular support 251 and sandwiched between the rectangular support 251 and the columnar supports 252 and 253. A cutout 255 is formed between the two columnar supports 252 and 253 which are to be inserted respectively in the centers of the secondary windings 240*a* and 240*b*, and a cutout 265 is formed at the magnetic core 260. The magnetic coupling between the secondary windings 240*a* and 240*b* is caused to weaken due to the cutouts 255 and 265, thus preventing the interference of the magnetic fluxes flowing through the columnar supports 252 and 253. And, since the primary windings 240*a* and 240*b* are wound in opposite directions with the same turn number, reverse polarity voltages are outputted respectively at the primary windings 240*a* and 240*b*.

Patent Document 1: Japanese Patent Application Laid-Open No. 2002-353044

Patent Document 2: Japanese Patent Application Laid-Open No. 2001-148318

SUMMARY OF THE INVENTION

Problems to be Solved

While one inverter transformer of FIG. 12 can drive a plurality of CCFLs with a double voltage as described above, the magnetic core 250 has a complicated structure making it difficult to produce, which pushes up production cost. And, if the inverter transformer, which has two secondary windings for two outputs in the example of FIG. 12, is modified to provide further secondary windings, then the magnetic core 250 is put into a more complicated structure.

On the other hand, the magnetic core structure of the inverter transformer 120 of FIG. 11 has a simple configuration composed of the frame core 121 and the I-cores 123*a*, 123*b* and 123*c* disposed inside the frame core 121, and therefore is favorable in terms of productivity. Output voltages with an identical polarity are induced at the secondary windings 125*a*, 125*b* and 125*c*, and the three I-cores 123*a*, 123*b* and 123*c* are arranged with a substantially equal interval space therebetween. Under such a core arrangement, if any one of the output voltages induced at the secondary windings 125*a*, 125*b* and 125*c* is to have its polarity reversed from the polarity of the other output voltages, the withstand voltage between two adjacent secondary windings at which reverse polarity output voltages are induced is not sufficient, especially at the high potential side, resulting in that a corona discharge or spark discharge occurs possibly causing ignition in some cases.

The present invention has been made in light of the above problems, and it is an object of the present invention to provide an inverter transformer for lighting a plurality of lamps, which has a plurality of output voltages including reversed polarity output voltages while ensuring a reliable insulation performance, and which is produced in a small size and at a low cost.

Means for Solving the Problems

In order to solve the problems for achieving the object described above, according to an aspect of the present invention, there is provided an inverter transformer which includes: a magnetic core assembly including a plurality of legs; and a plurality of bobbins which each have a primary winding and a secondary winding wound therearound, and which each have one of the plurality of legs inserted therein. In the inverter transformer described above, adjacent two bobbins of the plurality of bobbins, or a second bobbin pair which are provided with respective secondary winding at which output voltages having an identical polarity are induced, wherein an insulation distance setting means is provided between the two bobbins constituting the first bobbin pair so that a distance between the secondary windings disposed at the two bobbins constituting the first bobbin pair is larger than a distance between the secondary windings disposed at the two bobbins constituting the second bobbin pair.

Since the insulation distance setting means is provided between the two bobbins constituting the first bobbin pair which are provided with respective secondary windings at which output voltages having their polarities reversed from each other are induced, the distance between the secondary windings disposed at the two bobbins constituting the first bobbin pair is larger than the distance between the secondary windings disposed at the two bobbins constituting the second bobbin pair which are provided with respective secondary winding at which output voltages having an identical polarity are induced. Consequently, an inverter transformer with a plurality of outputs including reverse polarity output voltages can be achieved with a plurality of bobbins arranged in a space efficient manner while ensuring a reliable insulation performance, whereby a small inverter transformer with mounting area comparatively small for the number of outputs can be provided inexpensively.

Also, the present invention, which is suitably applied to an inverter transformer with four to six outputs, may further be applied advantageously to a large backlight device, for example, for use in, an LCD television, where the number of outputs (that is the number of bobbins having a secondary winding) of an inverter transformer is large, and therefore the space efficient structure exhibits its advantageous effects sufficiently.

In the aspect of the present invention, the insulation distance setting means may be constituted by extensions formed integrally at one side of the bobbin, the two bobbins of the first bobbin pair may be coupled to each other such that the extensions of one bobbin are engaged with a non-extended plain side of the other bobbin, and the two bobbins of the second bobbin pair may be coupled to each other with their respective non-extended plain sides engaging with each other. Alternatively, in the aspect of the present invention, the insulation distance setting means may be constituted by a spacer member made of a non-magnetic material and formed separately from the bobbin, the two bobbins of the first bobbin pair may be coupled to each other such that one side of one bobbin is engaged with one side of the spacer member and one side of the other bobbin is engaged with the other side of the spacer member, and the two bobbins of the second bobbin pair may be coupled to each other with their respective sides engaging with each other.

With the insulation distance setting means structured as described above, an inverter transformer can be produced in a simple and inexpensive structure. Also, the plurality of bobbins can be securely and efficiently coupled to one another with or without some spacer members. And, if the spacer member is used as the insulation distance setting means, the distance required for securing a withstand voltage between the secondary windings can be readily adjusted by changing the width dimension of the spacer member. In the aspect of the present invention, the inverter transformer may be a leakage transformer, whereby the leakage inductance of the inverter transformer functions as a ballast when lighting CCFLs connected at the secondary side of the inverter transformer.

Effect of the Invention

According to the present invention, with the structure described above, a small size and low cost inverter transformer for lighting multiple lamps can be provided which has a plurality of outputs including reverse polarity output voltages while ensuring a reliable insulation performance.

DETAILED DESCRIPTION OF THE INVENTION

Exemplary embodiments of the present invention will hereinafter be described with reference to the accompanying drawings.

Figure 1:
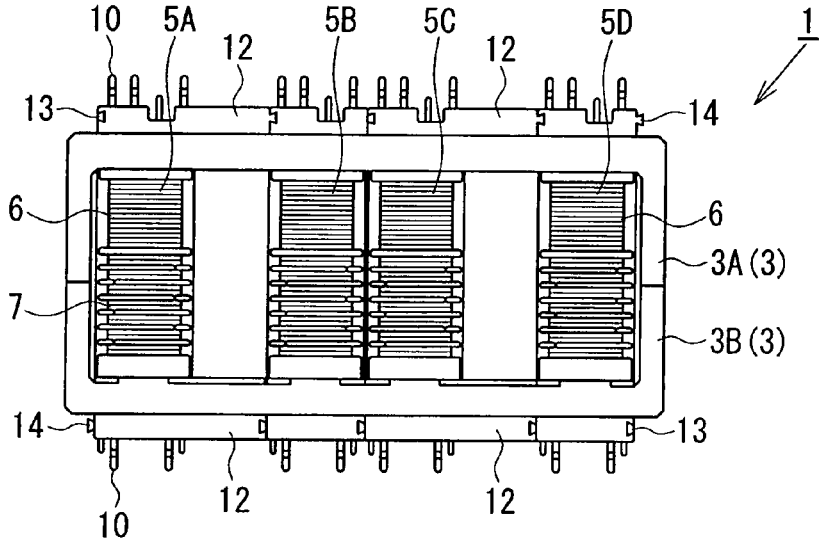
FIG. 1 is a top plan view of an inverter transformer according to a first embodiment of the present invention.

A first embodiment of the present invention will be described with reference to FIGS. 1 and 2. An inverter transformer 1 according to the first embodiment has four outputs and includes a magnetic core assembly 3, and four bobbins 5A to 5D each having a primary winding 6 and a secondary winding 7 wound therearound. The magnetic core assembly 3 is composed of two magnetic cores 3A and 3B put together. The magnetic core 3A is preferably made of Ni—Zn ferrite and includes six legs 3*a* to 3*f* and a bar 3*g* bridging respective one ends of the legs 3*a* to 3*f*, and likewise the magnetic core 3B is preferably made of Ni—Zn ferrite and includes six legs 3*a*' to 3*f*' and a bar 3*g*' bridging respective one ends of the legs 3*a*' to 3*f*'. The legs 3*b*' to 3*e*' of the magnetic core 3B are slightly shorter than the legs 3*a*' and 3*f*' thereof, and when the magnetic core assembly 3 is set up such that the magnetic cores 3A and 3B are put together with respective open ends of their legs opposing each other, there is an air gap provided between each of the legs 3*b* to 3*f* of the magnetic core 3A and each of the legs 3*b*' to 3*f*' of the magnetic core 3B. Thus, the inverter transformer 1 is a leakage transformer having a prescribed leakage inductance according to the air gap. In this connection, the magnetic cores 3A and 3B which constitute the magnetic core assembly 3 may be configured identically with each other, provided that the inverter transformer has a prescribed leakage inductance.

The bobbins 5A to 5D each having the primary and secondary windings 6 and 7 wound therearound are telescoped respectively over the legs 3*b*+3*b*', 3*c*+3*c*', 3*d*+3*d*' and 3*e*+3*e*' of the magnetic core assembly 3. The bobbins 5A to 5D are preferably made of a liquid crystal polymer material, wherein the bobbins 5A and 5C are configured identically with each other, and the bobbins 5B and 5D are configured identically with each other but differently from the bobbins 5A and 5C.

Each of the bobbins 5B and 5D includes a spool portion 8 and two terminal blocks 9A and 9B disposed respectively at both ends of the spool portion 8, and terminal pins 10 are implanted in the terminal blocks 9A and 9B. Nine flanges 11*a* to 11*i* (refer to the bobbin 5D) are formed integrally at the outer circumference of the spool portion 8, the primary winding 6 is disposed between the flange 11*a* and the flange 11*b*, and the secondary winding 7 is disposed between the flange 11*b* and the flange 11*i* so as to be divided into a plurality (seven in the figure) of sub-coils 7*a* to 7*g* (refer to the bobbin 5A) by the flanges 11*c* to 11*h*. The terminal block 9A has a recess 13 at one side thereof and a boss 14 at the other side thereof, and the terminal block 9B has a boss 14 at one side thereof (the one side corresponding to one side of the terminal block 9A) and a recess 13 at the other side thereof.

The bobbins 5A and 5C, like the bobbins 5B and 5D, each include a spool portion 8 and two terminal blocks 9A and 9B disposed respectively at both ends of the spool portion 8. Nine flanges 11*a* to 11*i* are formed integrally at the outer circumference of the spool portion 8, the primary winding 6 is disposed between the flange 11*a* and the flange 11*b*, and the secondary winding 7 is disposed between the flange 11*b* and the flange 11*i* so as to be divided into a plurality (seven in the figure) of sub-coils 7*a* to 7*g* by the flanges 11*c* to 11*h*. The bobbin 5A/5C differs from the bobbin 5B/5D in that the terminal block 9A has an extension 12A integrally formed at one side thereof with the other side remaining plain, and the terminal block 9B has an extension 12B (similar to the extension 12A) integrally formed at one side thereof so as to extend in the same direction as the extension 12A with the other side remaining plain. The extensions 12A and 12B constitute an insulation distance setting means. The terminal block 9A has a recess 13 at the one side thereof formed with the extension 12A, that is, at the end of the extension 12A and has a boss 14 at the other side (plain side) thereof, and the terminal block 9B has a boss 14 at the one side thereof formed with the extension 12B, that is, at the end of the extension 12B and has a recess 13 at the other side (plain side) thereof.

A method of assembling the inverter transformer 1 will be described. The boss 14 at the extension 12B of the terminal block 9B of the bobbin 5A and the recess 13 at the terminal block 9B of the bobbin 5B are engaged with each other, then the recess 13 at the extension 12A of the terminal block 9A of the bobbin 5A and the boss 14 at the terminal block 9A of the bobbin 5B are engaged with each other, whereby the bobbin 5A and the bobbin 5B are coupled to each other with the extensions 12A and 12B sandwiched therebetween. In the same way, the boss 14 at the extension 12B of the terminal block 9B of the bobbin 5C and the recess 13 at the terminal block 9B of the bobbin 5D are engaged with each other, then the recess 13 at the extension 12A of the terminal block 9A of the bobbin 5C and the boss 14 at the terminal block 9A of the bobbin 5D are engaged with each other, whereby the bobbin 5C and the bobbin 5D are coupled to each other with the extensions 12A and 12B sandwiched therebetween. And, the boss 14 at the terminal block 9B of the bobbin 5B and the recess 13 at the terminal block 9B of the bobbin 5C are engaged with each other, then the recess 13 at the terminal block 9A of the bobbin 5B and the boss 14 at the terminal block 9A of the bobbin 5C are engaged with each other, whereby the bobbin 5B and the bobbin 5C are coupled to each other such that their plain sides without the extensions 12A and 12B are jointed together, thus the four bobbins 5A, 5B, 5C and 5D are solidly coupled in line. Then, the legs 3*b* to 3*e* of the magnetic core 3A are inserted in respective hollows (not shown) of the spool portions 8 of the bobbins 5A to 5D from the side of the terminal block 9B, the legs 3*b*' to 3*e*' of the magnetic core 3B are inserted in the respective hollows of the spool portions 8 of the bobbins 5A to 5D from the side of the terminal block 9A and brought into contact with the legs 3*a* to 3*e* of the magnetic core 3A, and the inverter transformer 1 is completed.

The primary and secondary windings 6 and 7 disposed at the bobbins 5A to 5D may be wound, for example, as follows. The primary windings 6 at the bobbins 5A and 5B are wound in the same direction, and the primary windings 6 at the bobbins 5C and 5D are wound in the same direction that is opposite to the winding direction of the primary windings 6 at the bobbins 5A and 5B. The secondary windings 7 at the bobbins 5A and 5C are wound in the same direction, and the secondary windings 7 at the bobbins 5B and 5D are wound in the same direction that is opposite to the winding direction of the secondary winding 7 at the bobbins 5A and 5C.

In the inverter transformer 1 with the above-described winding arrangement of the primary and secondary winding 6 and 7, when a same AC voltage is applied to the primary windings 6 at the bobbins 5A to 5D, a same output voltage is generated at the secondary windings 7 at the bobbins 5A to 5D such that the polarities at the bobbins 5A and 5B are reversed with their respective phases shifted from each other by 180 degrees, the polarities at the bobbins 5B and 5C are identical with each other, and that the polarities at the bobbins 5C and 5D are reversed with their respective phases shifted from each other by 180 degrees.

Thus, the potential difference is large between the secondary winding 7 at the bobbin 5A and the secondary winding 7 at the bobbin 5B, which is adjacent to the secondary winding 7 at the bobbin 5A, and which is provided with an output voltage reversed in polarity from the output of the secondary winding 7 at the bobbin 5A, and also between the secondary windings 7 at the bobbins 5C and 5D, and therefore a higher withstand voltage is required between the secondary windings 7 at the bobbins 5A and 5B and between the secondary windings 7 at the bobbins 5C and 5D than between the secondary windings 7 at the bobbins 5B and 5C, which are adjacent to each other and are provided with an identical polarity.

Under the circumstances described above, the bobbin 5A is connected to the bobbin 5B with the extensions 12A and 12B of the bobbin 5A sandwiched therebetween thereby securing a distance substantially corresponding to the protrusion dimension of the extension 12A/12B between the secondary windings 7 at the bobbins 5A and 5B: two bobbins connected to each other with an insulation distance setting means sandwiched therebetween, like the bobbins 5A and 5B as described above, are referred to as "first bobbin pair" as appropriate. In the same way, the bobbin 5C is connected to the bobbin 5D with the extensions 12A and 12B of the bobbin 5C sandwiched therebetween thereby securing a distance substantially corresponding to the protrusion dimension of the extension 12A/12B between the secondary windings 7 at the bobbins 5C and 5D, thus constituting another first bobbin pair. On the other hand, the bobbins 5B and 5C are connected directly to each other without any intermediate members like extensions 12A and 12B therebetween thus providing no extra and unnecessary space therebetween: two bobbins connected directly to each other, like the bobbins 5B and 5C as described above, are referred to as "second bobbin pair" as appropriate.

Accordingly, in the inverter transformer 1, the distance between the secondary windings 7 at the bobbins 5A and 5B (first bobbin pair), at which reverse output voltages are induced, and also between the secondary windings 7 at the bobbins 5C and 5D (first bobbin pair) is larger than the distance between the secondary windings 7 at the bobbins 5B and 5C (second bobbin pair), at which an identical polarity voltage is induced, whereby an inverter transformer with multiple outputs is provided which has a reliable insulation performance, and in which a plurality of bobbins are arranged in a compact layout.

The present invention is not limited to any specific arrangement of the winding direction of the primary and secondary windings at the respective bobbins, and the primary and secondary windings may be wound in any appropriate directions in view of various design conditions including the specification of an inverter circuit to which the inverter transformer is connected, insofar as the output voltages induced at the secondary windings are predeterminedly polarized. This winding concept applies to the following embodiments, and description on the winding direction at the bobbins will be omitted below.

A second embodiment of the present invention will be described with reference to FIG. 3. Referring to FIG. 3, an inverter transformer 20 according to the second embodiment includes a magnetic core assembly 3 composed of two magnetic cores 3A and 3B which are identical with those of the inverter transformer 1 according to the first embodiment, and has a performance property equivalent to that of the inverter transformer 1. The inverter transformer 20 differs from the inverter transformer 1 mainly in that four bobbins 21A to 21D are configured identically with one another, and that a spacer member 22 is used as an insulation distance setting means. For example, the bobbin 5B/5D of FIG. 2 may be used for the four bobbins 21A to 21D.

The spacer member 22 is made of a non-magnetic material, preferably of the same material as the bobbins 21A to 21D, for example, liquid crystal polymer. The spacer member 22 has a recess 13 at one side (toward the left in the figure) of one end (upper in the figure) thereof and a boss 14 at the other side (toward the right in FIG. 3) of the one end thereof, and has a boss 14 at one side (toward the left in the figure) of the other end (lower in the figure) thereof and a recess 13 at the other side (toward the left in the figure) of the other end thereof. The spacer member 22 defines a width dimension substantially equal to, for example, the protrusion dimension of the extension 12A/12B in the first embodiment.

The inverter transformer 20 is assembled as follows. A boss 14 and a recess 13 formed respectively at terminal blocks 9B and 9A of the bobbin 21A are engaged respectively with the recess 13 and the boss 14 at the one side of the spacer member 22, and then the boss 14 and the recess 13 at the other side of the spacer member 22 are engaged respectively with a recess 13 and a recess 14 formed respectively at terminal blocks 9B and 9A of the bobbin 21B, whereby the bobbins 21A and 21B are coupled to each other with the spacer member 22 sandwiched therebetween. In the same way, the bobbins 21C and 21D are coupled to each other with the spacer member 22 sandwiched therebetween. And, a boss 14 and a recess 13 formed respectively at the terminal blocks 9B and 9A of the bobbin 21B are engaged respectively with a recess 13 and a boss 14 formed at terminal blocks 9B and 9A of the bobbin 21C, whereby the four bobbins 21A to 21D are solidly coupled in line. Then, legs 3*b* to 3*e* of the magnetic core 3A and legs 3*b*' to 3*e*' of the magnetic core 3B are inserted in respective hollows (not shown) of spool portions 8 of the bobbins 21A to 21D from respective both sides of the terminal blocks 9B and 9A and brought into contact with each other, and the inverter transformer 20 is completed.

In the inverter transformer 20 assembled as described above, the bobbins 21A and 21B are coupled to each other with the spacer member 22 sandwiched therebetween, thus constituting a first bobbin pair where a distance substantially corresponding to the width dimension of the spacer member 22 is provided between secondary windings 7 at the two bobbins 21A and 21B, and the bobbins 21C and 21D constitute another first bobbin pair in the same way and a distance substantially corresponding to the width dimension of the spacer member 22 is provided between secondary windings 7 at the two bobbins 21C and 21D. On the other hand, the bobbins 21B and 21C are coupled directly to each other side by side with no extra and unnecessary space provided therebetween, thus constituting a second bobbin pair.

The inverter transformer 20 structured as described above, which includes the bobbins 21A to 21D configured identically with one another and the spacer members 22, achieves the same effects as the inverter transformer 1 according to the first embodiment. Further, in the inverter transformer 20, since the width dimension of the insulation distance setting means can be easily changed by using plural kinds of spacer members, or combining a single kind and/or plural kinds of spacer members, the distance or space between two secondary windings 7 which have their respective output voltages polarized oppositely to each other can be flexibly adjusted for providing an appropriate withstand voltage therebetween.

Figure 4:
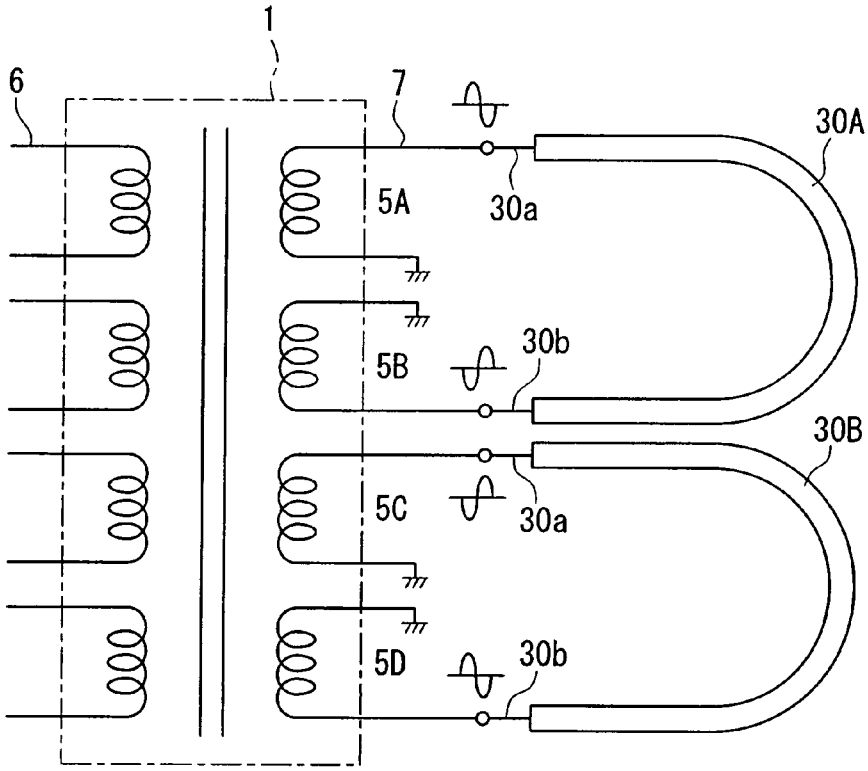
FIG. 4 is a circuit diagram of the inverter transformer of FIG. 1, additionally showing discharge lamps to be lit.

FIG. 4 shows an example circuitry as an application of the inverter transformer according to the first or second embodiments for lighting a plurality of discharge lamps. Referring to FIG. 4, one inverter transformer 1 of FIG. 1 is adapted to light two CCFLs 30A and 30B each bent in a U-shape and having electrodes 30*a* and 30*b* at both ends. One electrode 30*a* of the CCFL 30A is connected to one terminal of the secondary winding 7 at the bobbin 5A, and the other electrode 30*b* of the CCFL 30A is connected to one terminal of the secondary winding 7 at the bobbin 5B. One electrode 30*a* of the CCFL 30B is connected to one terminal of the secondary winding 7 at the bobbin 5C, and the other electrode 30*b* of the CCFL 30B is connected to one terminal of the secondary winding 7 at the bobbin 5D. And, the other terminals of the respective secondary windings 7, to which the CCFLs 30A and 30B are not connected, are grounded.

The primary windings 6 of the bobbins 5A to 5D are connected to an inverter circuit (not shown) which drives the primary windings 6 by a common AC voltage thereby supplying the electrodes 30*a* and 30*b* of the CCFL 30A/30B respectively with reverse polarity AC voltages which have their respective phases shifted from each other by 180 degrees, thus driving the CCFLs 30A and 30B with a double voltage.

The structure of FIG. 4 is shown as lighting the two U-shape CCFLs 30A and 30B, but each of the two U-shape CCFLs 30A and 30B may be replaced with a pair of straight CCFLs. In this case, the low voltage side electrodes of two straight CCFLs of the pair are connected to each other, and the high voltage side electrodes of the two straight CCFLs are connected to respective one terminals of the secondary windings 7 at, for example, the bobbins 5A and 5B, which are not connected to ground, whereby the two straight CCFLs coupled into one pair are driven with a double voltage such that reverse polarity AC voltages which have their respective phases shifted from each other by 180 degrees are applied to the respective electrodes of the CCFLs. And, if another two straight CCFLs constituting a pair are connected to respective one ungrounded terminals of the secondary windings 7 at the bobbins 5C and 5D, then four straight CCFLs can be lit by the circuitry shown in FIG. 4.

Figure 5:
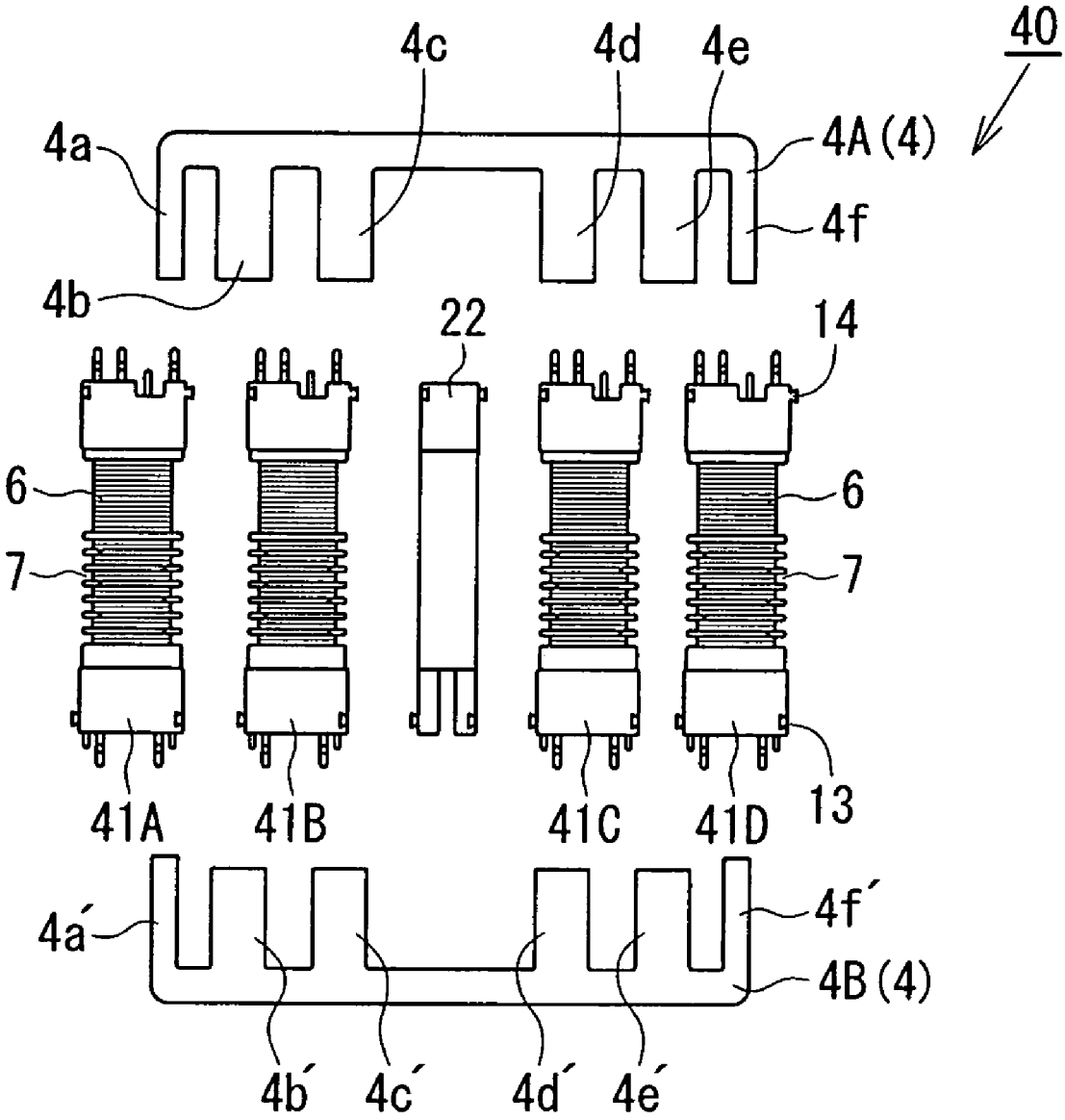
FIG. 5 is an exploded top plan view of an inverter transformer according to a third embodiment of the present invention.

A third embodiment of the present invention will be described with reference to FIG. 5. Referring to FIG. 5, an inverter transformer 40 according to the third embodiment are with four outputs like the inverter transformers 1 and 20 according to the first and second embodiments but differs therefrom in disposition of first and second bobbin pairs.

While the inverter transformer 40 is identical or similar in structure and constituent members to the inverter transformer 20 according to the second embodiment, a magnetic core assembly 4 is composed of two magnetic cores 4A and 4B which are different from the magnetic cores 3A and 3B of FIG. 3 in that their respective legs 4*b* to 4*e* and 4*b*' to 4*e*' are positioned corresponding to the disposition of bobbins 41A to 41D. The bobbins 41A to 41D and a spacer member 22 are identically structured with the bobbins 21A to 21D and the spacer member 22 shown in FIG. 3.

In the inverter transformer 40, respective output voltages at secondary windings 7 at the bobbins 41A and 41B have an identical polarity, respective output voltages at secondary windings 7 at the bobbins 41C and 41D have an identical polarity, and respective output voltages at the secondary windings 7 at the bobbins 41B and 41C have their polarities reversed with respect to each other. Accordingly, the bobbins 41B and 41C are coupled to each other with the spacer member 22 sandwiched therebetween constituting a first bobbin pair, the bobbins 41A and 41B are coupled directly to each other side by side without the spacer member 22 therebetween constituting a second bobbin pair, and the bobbins 41C and 41D are coupled directly to each other side by side without the spacer member 22 therebetween constituting another second bobbin pair. The inverter transformer 40 thus structured achieves the same effects as the inverter transformers 1 and 20 according to the first and second embodiments.

Figure 6:
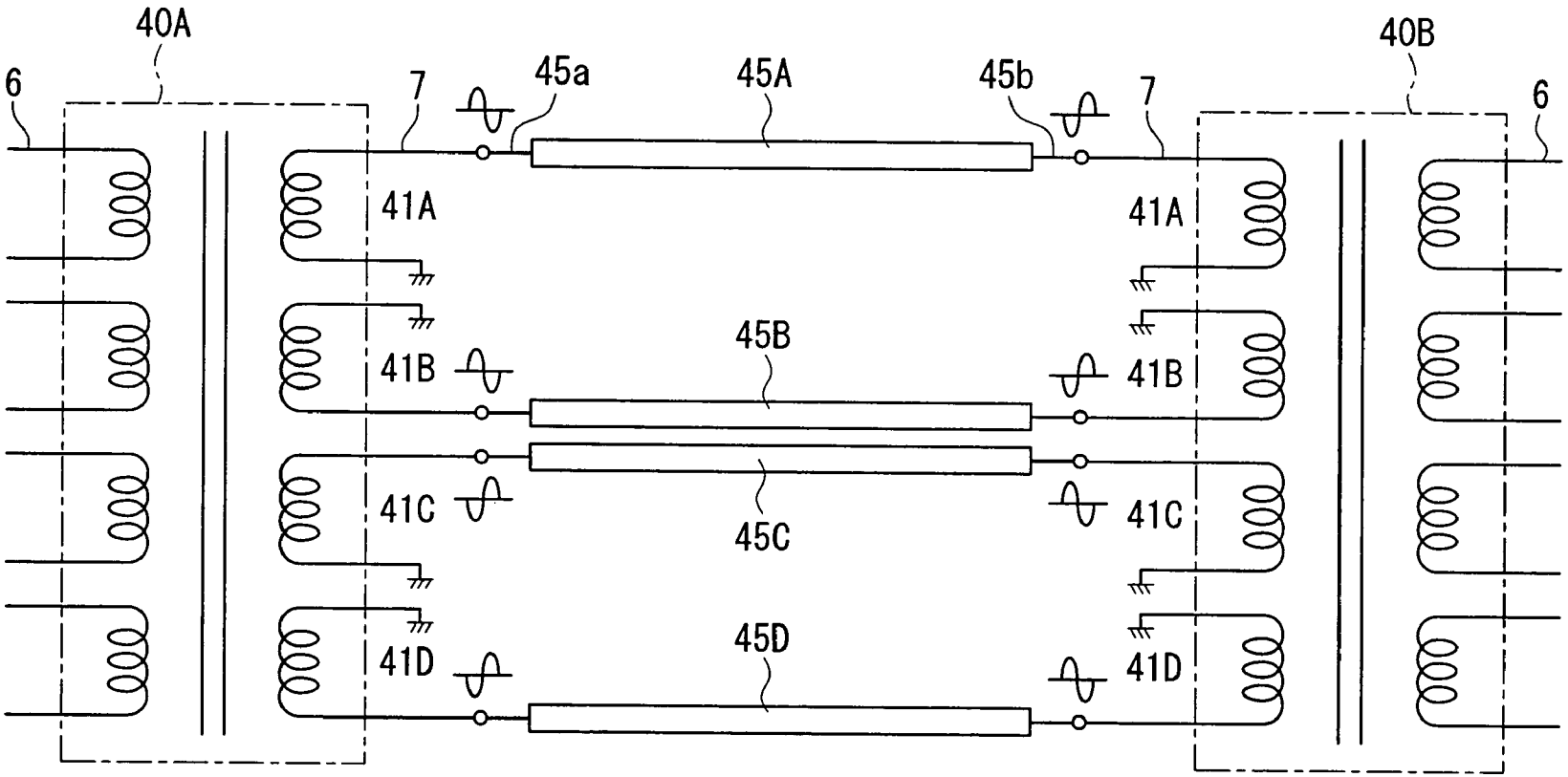
FIG. 6 is a circuit diagram of the inverter transformer of FIG. 5.

FIG. 6 shows an example circuitry as an application of the inverter transformer 40 of FIG. 5 according to the third embodiment for lighting a plurality of discharge lamps, wherein two of the inverter transformers 40 are used. Referring to FIG. 6, two inverter transformers 40A and 40B, each of which corresponds to the inverter transformer 40 of FIG. 5, are adapted to light a plurality (four in the figure) of straight CCFLs 45A to 45D which each have an electrode at each of both ends thereof. The two inverter transformers 40A and 40B are respectively disposed at the both ends of the CCFLs 45A to 45D. Specifically, one electrode 45*a* of the CCFL 45A is connected to one terminal of a secondary winding 7 at the bobbin 41A of the inverter transformer 40A, and the other electrode 45*b* of the CCFL 45A is connected to one terminal of a secondary winding 7 at the bobbin 41A of the inverter transformer 40B. In the same way, one electrodes 45*a* of the CCFLs 45B to 45D are connected to respective one terminals of secondary windings 7 at the bobbins 41B to 41D of the inverter transformers 40A, and the other electrodes 45*b* of the CCFLs 45B to 45D are connected to respective one terminals of secondary windings 7 at the bobbins 41B to 41D of the inverter transformer 40B. And, the other terminals of the respective secondary windings 7, to which the CCFLs are not connected, are grounded.

Primary windings 6 at the bobbins 41A to 41D of the inverter transformer 40A and primary windings 6 at the bobbins 41A to 41D of the inverter transformer 40B are connected to an inverter circuit (not shown) which, for example, supplies the primary windings 6 at the bobbins 41A to 41D of the inverter transformer 40A with a common drive voltage while supplying the primary windings 6 at the bobbins 41A to 41D of the inverter transformer 40B with a common AC voltage which has a polarity reversed from the polarity of the common drive voltage for the inverter transformer 40A. Thus, reverse polarity AC output voltages which have respective phases shifted from each other by 180 degrees are applied to the both electrodes 45*a* and 45*b* of the CCFLs 45A to 45D, thereby driving the CCFLs 45A to 45D with a double voltage. In this case, opposite polarity output voltages from the secondary windings 7 are applied respectively to a pair of the CCFLs 45A and 45B and a pair of the CCFLs 45C and 45D as shown in FIG. 6.

In the circuitry shown in FIG. 6, the windings may alternatively be arranged, for example, such that the windings at the bobbins 41A to 41D of the inverter transformer 40A are wound in the direction opposite to the winding direction of the windings at the bobbins 41A to 41D of the inverter transformer 40B, wherein all the primary windings 6 of the inverter transformers 40A and 40B are driven by a common AC voltage.

Figure 7:
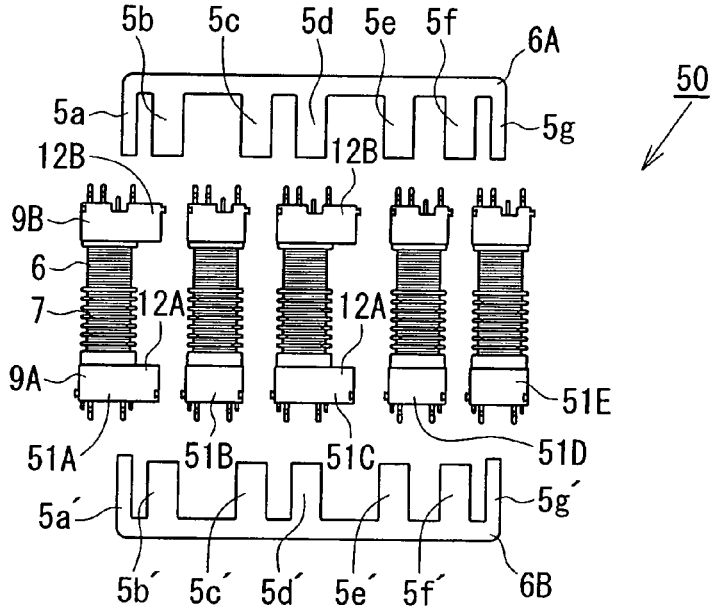
FIG. 7 is an exploded top plan view of an inverter transformer according to a fourth embodiment of the present invention.

A fourth embodiment of the present invention will be described with reference to FIG. 7. Referring to FIG. 7, an inverter transformer 50 according to the fourth embodiment is with five outputs and includes five bobbins 51A to 51E each having a secondary winding 7 wound therearound.

Figure 2:
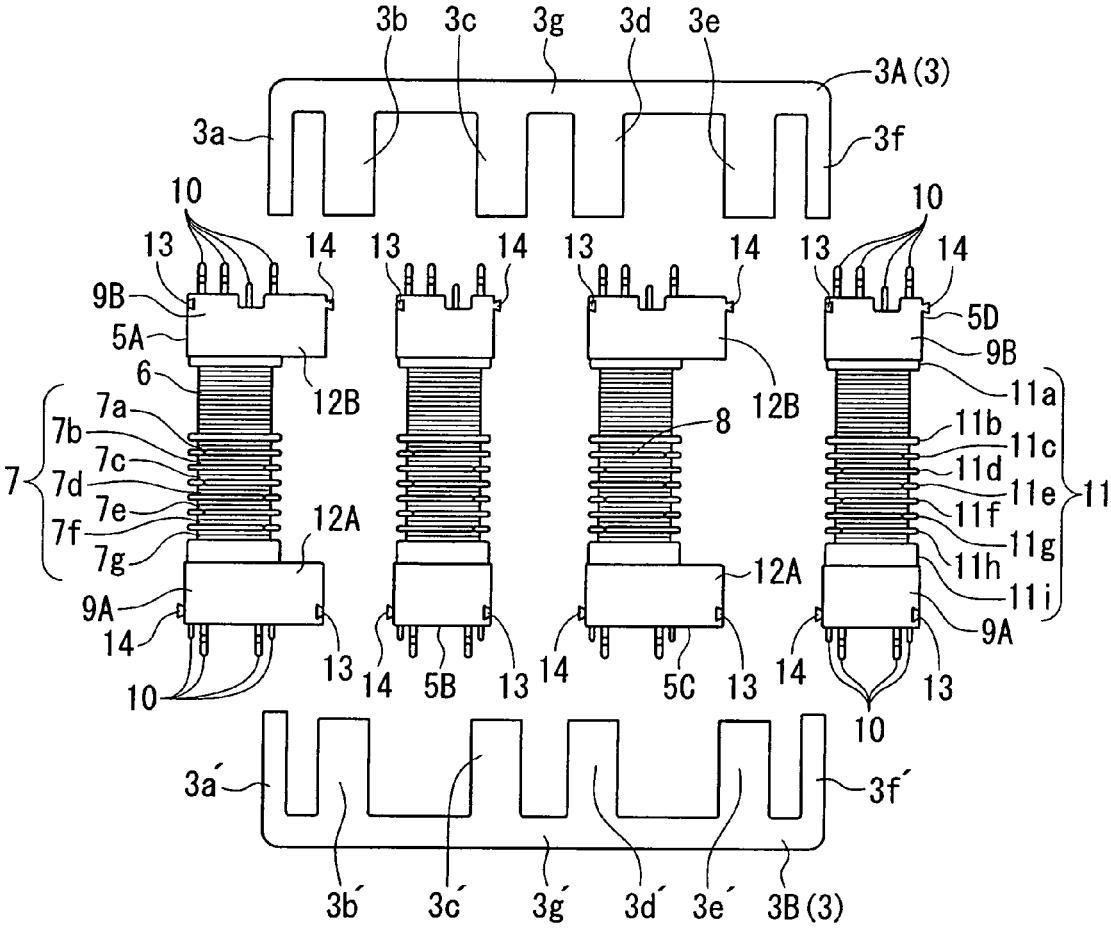
FIG. 2 is an exploded view of the inverter transformer of FIG. 1.
Figure 3:
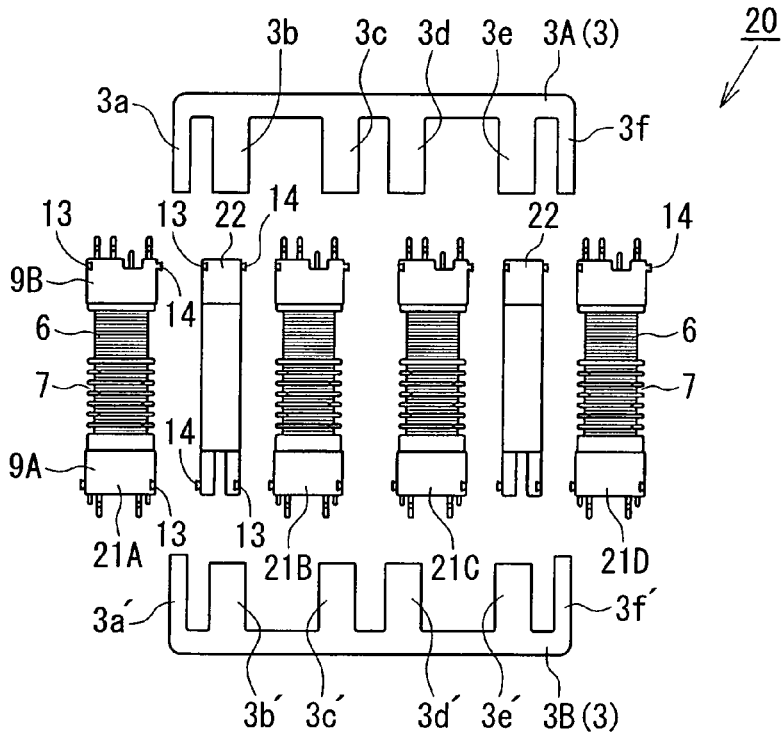
FIG. 3 is an exploded top plan view of an inverter transformer according to a second embodiment of the present invention.

The inverter transformer 50 uses constituent members identical with those of the inverter transformer 1 according to the first embodiment except magnetic cores 6A and 6B which differ respectively from the magnetic cores 3A and 3B of FIG. 2 in that the magnetic cores 6A and 6B each include seven legs 5*a*/5*a*' to 5*g*/5*g*', rather than six legs, in order to match the increased number of bobbins. The bobbins 51A and 51C are identical with each other and identical with the bobbin 5A/5C of FIG. 2, and the bobbins 51B, 51D and 51E are identical with one another and identical with the bobbin 5B/5D of the FIG. 2.

Respective output voltages induced at the secondary windings 7 at the bobbins 51A and 51B have their polarities reversed with respect to each other, respective output voltages induced at the secondary windings 7 at the bobbins 51C and 51D have their polarities reversed with respect to each other, and respective output voltages induced at the secondary windings 7 at the bobbins 51D and 51E have an identical polarity. Accordingly, the bobbins 51A and 51B are coupled to each other with extensions 12A and 12B of the bobbin 51A sandwiched therebetween thus constituting a first bobbin pair, and the bobbins 51C and 51D are coupled to each other in the same way constituting another first bobbin pair. On the other hand, the bobbins 51B and 51C are coupled directly to each other side by side without such extension members thus constituting a second bobbin pair, and the bobbins 51D and 51E are coupled to each other in the same way constituting another second bobbin pair. With the structure described above, the inverter transformer 50 achieves the same effects as the inverter transformers according to the precedent embodiments.

Figure 8:
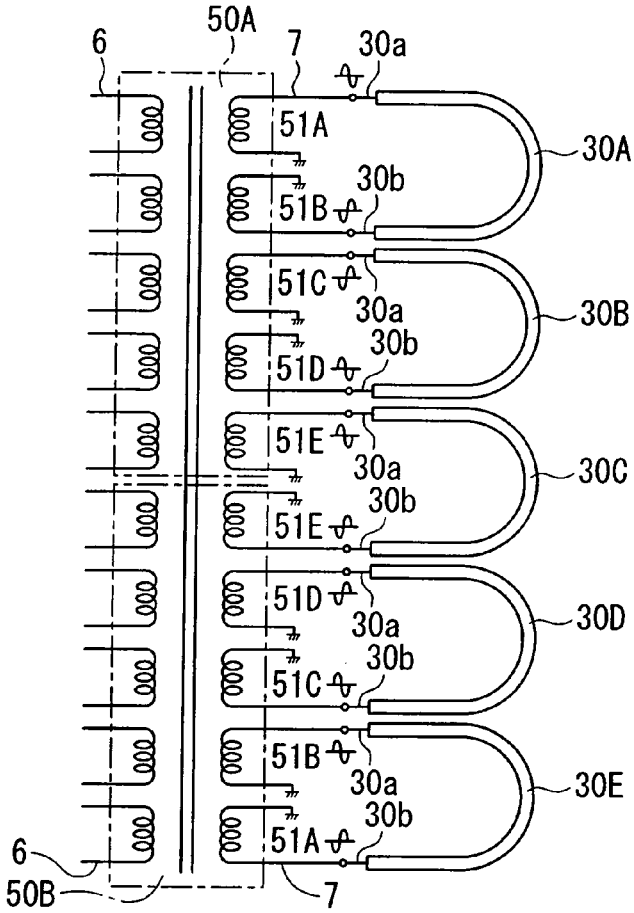
FIG. 8 is a circuit diagram of the inverter transformer of FIG. 7.

FIG. 8 shows an example circuitry as an application of the inverter transformer 50 of FIG. 7 according to the fourth embodiment for lighting a plurality of discharge lamps, wherein two of the inverter transformers 50 are used. Referring to FIG. 8, two inverter transformers 50A and 50B, each of which corresponds to the inverter transformer 50 of FIG. 7, are adapted to light a plurality of U-shape CCFLs 30A to 30E which each have an electrode at each of both ends thereof. Specifically, one electrode 30*a* of the CCFL 30A is connected to one terminal of the secondary winding 7 at the bobbin 51A of the inverter transformer 50A, and the other electrode 30*b* of the CCFL 30A is connected to one terminal of the secondary winding 7 at the bobbin 51B of the inverter transformer 50A. In the same way, electrodes 30*a* and 30*b* of the CCFL 30B are connected to respective one terminals of the secondary windings 7 at the bobbins 51C and 51D of the inverter transformers 50A, electrodes 30*a* and 30*b* of the CCFL 30D are connected to respective one terminals of the secondary windings 7 at the bobbins 51D to 51C of the inverter transformer 50B, and electrodes 30*a* and 30*b* of the CCFL 30E are connected to respective one terminals of the secondary windings 7 at the bobbins 51B and 51A of the inverter transformer 50B. And, one electrode 30*a* of the CCFL 30C is connected to one terminal of the secondary winding 7 at the bobbin 51E of the inverter transformer 50A, and the other electrode 30*b* of the CCFL 30C is connected to one terminal of the secondary winding 7 at the bobbin 51E of the inverter transformer 50B. The other terminals of the respective secondary windings 7, to which the CCFLs are not connected, are grounded.

Primary windings 6 at the bobbins 51A to 51E of the inverter transformer 50A and primary windings at the bobbins 51A to 51E of the inverter transformer 40B are connected to an inverter circuit (not shown) which, for example, supplies the primary windings 6 at the bobbins 51A to 51E of the inverter transformer 50A with a common drive voltage while supplying the primary windings 6 at the bobbins 51A to 51E of the inverter transformer 50B with a common AC voltage which has a polarity reversed from the polarity of the common drive voltage for the inverter transformer 50A. Thus, reverse polarity AC output voltages which have respective phases shifted from each other by 180 degrees are applied to the both electrodes 30*a* and 30*b* of the CCFLs 30A to 30E, thereby driving the CCFLs 30A to 30E with a double voltage. In this case, opposite polarity output voltages are induced respectively at the secondary windings 7 at the bobbins 51E and 51E of the inverter transformers 50A and 50B, and therefore the inverter transformers 50A and 50B are to be disposed such that the respective bobbins 51E and 51E are not close to each other.

In the circuitry shown in FIG. 8, the windings may alternatively be arranged, for example, such that the windings at the bobbins 51A to 51E of the inverter transformer 50A are wound in the direction opposite to the winding direction of the windings at the bobbins 51A to 51E of the inverter transformer 50B, wherein all the primary windings 6 of the inverter transformers 50A and 50B are driven by a common AC voltage.

Also, like the alternative CCFL arrangement explained with reference to FIG. 4, two straight CCFLs may be paired for one U-shape CCFL with their low voltage side electrodes connected to each other, and their high voltage side electrodes are connected to respective one terminals of the secondary windings 7, for example, at the bobbins 51A and 51B of the inverter transformer 50A, which are not connected to ground, whereby two straight CCFLs coupled into one pair are duly driven for each of the U-shape CCFLs 30A to 30E. Thus, the circuitry shown in FIG. 8 is capable of lighting five pairs of straight CCFLs, that is to say ten straight CCFLs.

Figure 9:
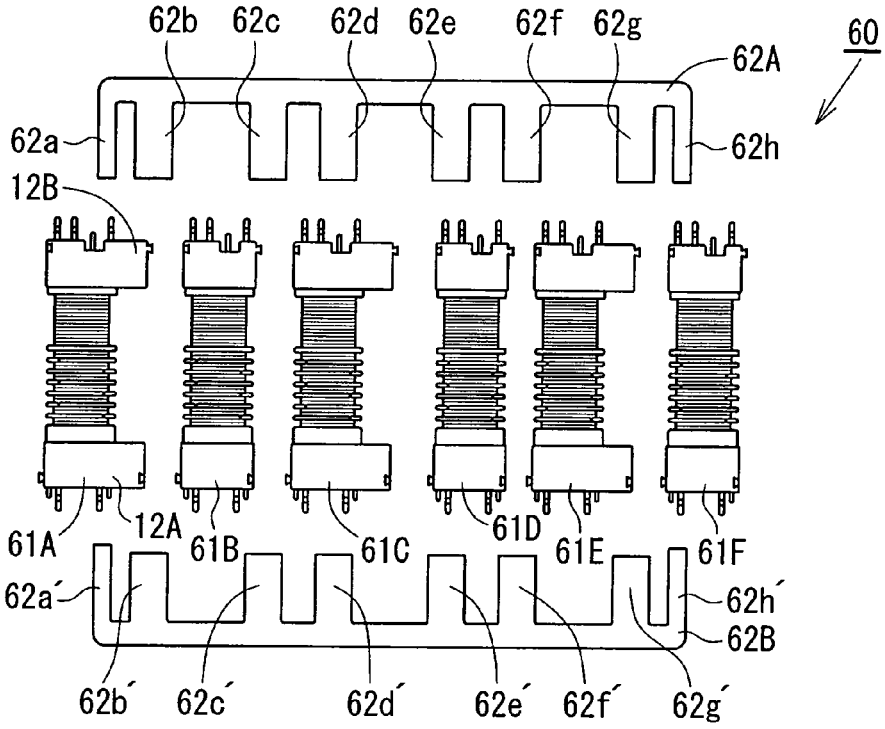
FIG. 9 is an exploded top plan view of an inverter transformer according to a fifth embodiment of the present invention.

A fifth embodiment of the present invention will be described with reference to FIG. 9. Referring to FIG. 9, an inverter transformer 60 according to the fifth embodiment is with six outputs and includes six bobbins each having a secondary winding 7 wound therearound.

The inverter transformer 60 uses constituent members identical with those of the inverter transformer 1 according to the first embodiment except magnetic cores 62A and 62B which differ respectively from the magnetic cores 3A and 3B of FIG. 2 in that the magnetic cores 62A and 62B each include eight legs 62*a*/62*a*' to 62*g*/62*g*', rather than six legs, in order to match the increased number of bobbins. The bobbins 61A, 61C and 61E are identical with one another and identical with the bobbin 5A/5C of FIG. 2, and the bobbins 61B, 61D and 61F are identical with one another and identical with the bobbin 5B/5D of the FIG. 2.

Respective output voltages induced at the secondary windings 7 at the bobbins 61A and 61B have their polarities reversed with respect to each other, respective output voltages induced at the secondary windings 7 at the bobbins 61C and 61D have their polarities reversed with respect to each other, and respective output voltages induced at the secondary windings 7 at the bobbins 61E and 61F have their polarities reversed with respect to each other, while respective output voltages induced at the secondary windings 7 at the bobbins 61B and 61C have an identical polarity, and respective output voltages induced at the secondary windings 7 at the bobbins 61D and 61E have an identical polarity. Accordingly, the bobbins 61A and 61B are coupled to each other with extensions 12A and 12B of the bobbin 61A sandwiched therebetween thus constituting a first bobbin pair, the bobbins 61C and 61D are coupled to each other in the same way constituting another first bobbin pair, and also the bobbins 61E and 61F are coupled to each other in the same way constituting still another first bobbin pair. On the other hand, the bobbins 61B and 61C are coupled directly to each other side by side without such extension members thus constituting a second bobbin pair, and the bobbins 61D and 61E are coupled to each other in the same way constituting another second bobbin pair. With the structure described above, the inverter transformer 60 achieves the same effects as the inverter transformers according to the precedent embodiments.

Figure 10:
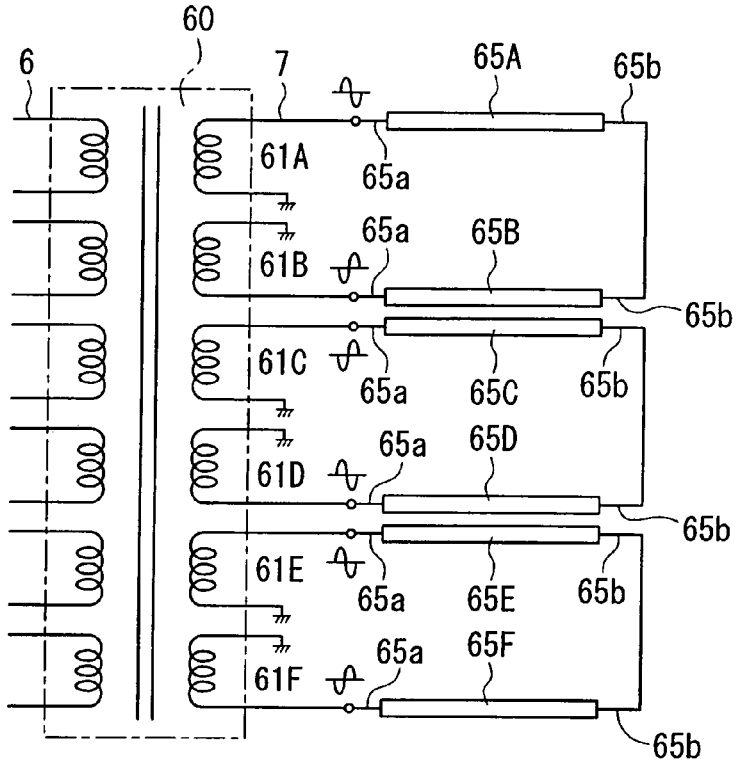
FIG. 10 is a circuit diagram of the inverter transformer of FIG. 9.
Figure 11:
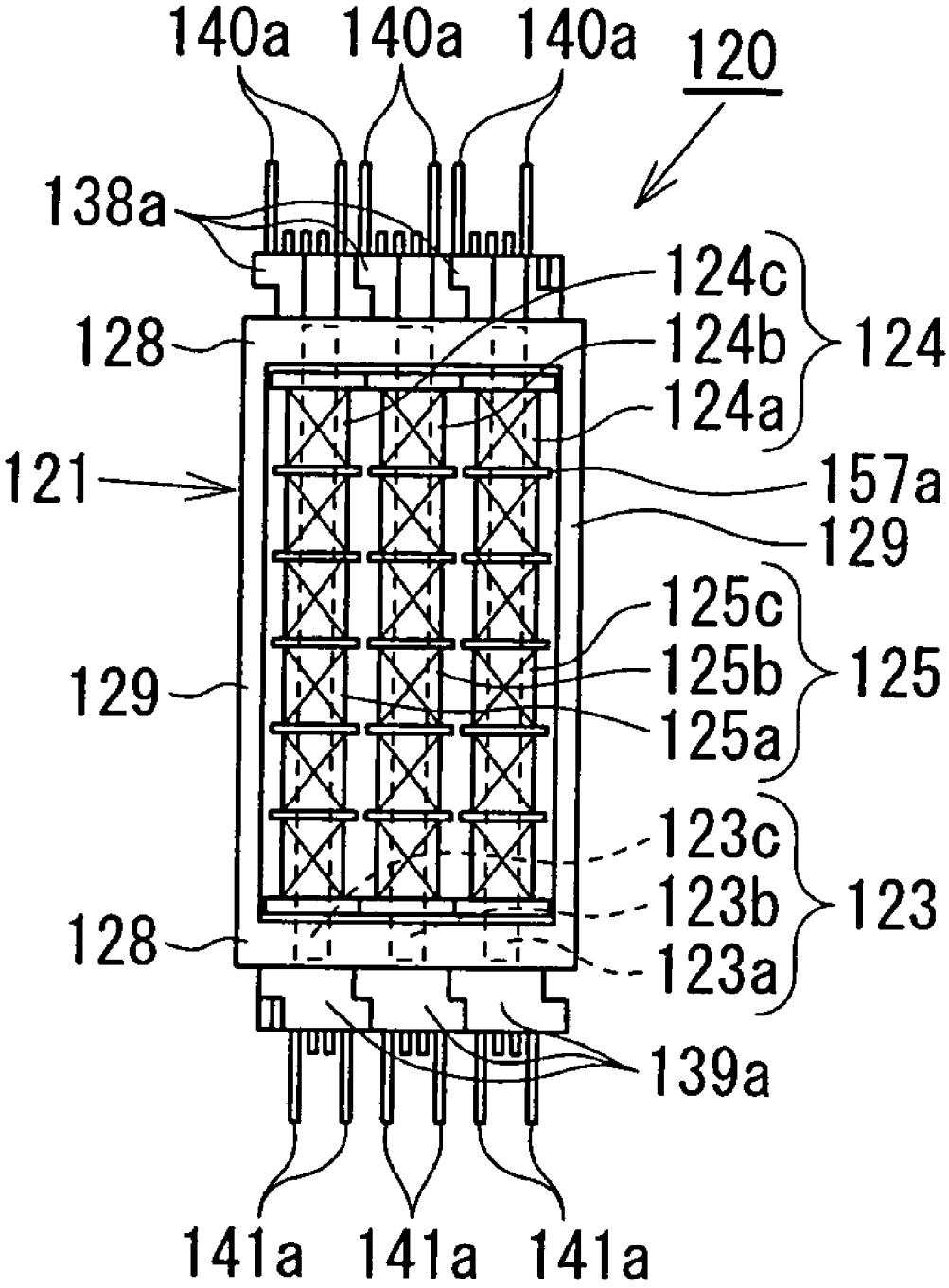
FIG. 11 (PRIOR ART)
FIG. 11 is a schematic plan view of a conventional inverter transformer.
Figure 12:
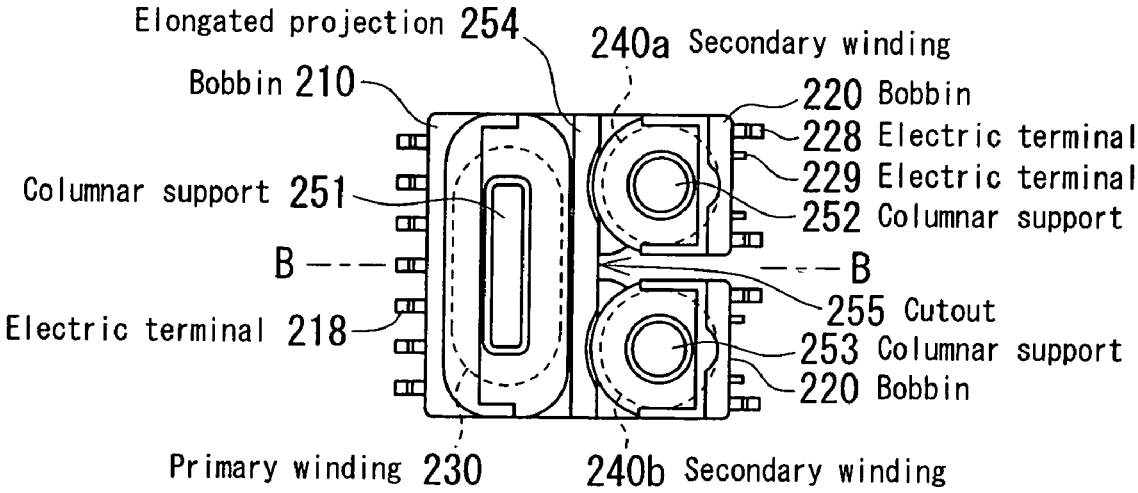
FIG. 12 (PRIOR ART)
FIG. 12 is a schematic plan view of another conventional inverter transformer.
Figure 13:
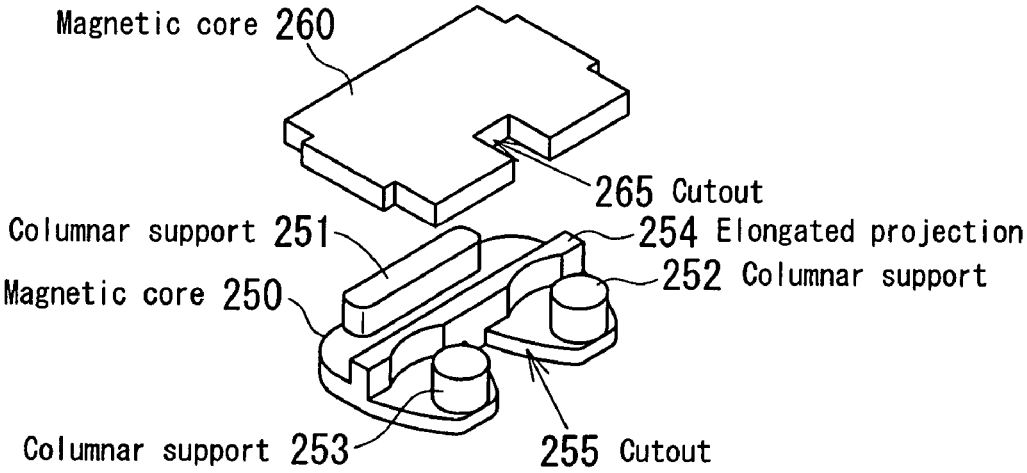
FIG. 13 (PRIOR ART)
FIG. 13 is an exploded perspective view of magnetic cores of the inverter transformer of FIG. 12.

FIG. 10 shows an example circuitry as an application of the inverter transformer 60 according to the fifth embodiments for lighting a plurality of discharge lamps. Referring to FIG. 10, two straight CCFLs 65A and 65B are paired with respective low voltage side electrodes 65*b* and 65*b* connected to each other, and the high voltage side electrodes 65*a* and 65*a* of the CCFLs 65A and 65B are connected to respective one terminals of the secondary windings 7 at the bobbins 61A and 61B. In the same way, two straight CCFLs 65C and 61D are paired with respective low voltage side electrodes 65*b* and 65*b* connected to each other while having their high voltage side electrodes 65*a* and 65*a* connected to respective one terminals of the secondary windings 7 at the bobbins 61C and 61D, and two straight CCFLs 65E and 61F are paired with respective low voltage side electrodes 65*b* and 65*b* connected to each other while having their high voltage side electrodes 65*a* and 65*a* connected to respective one terminals of the secondary windings 7 at the bobbins 61E and 61F. And, the other terminals of the respective secondary windings 7, to which the CCFLs are not connected, are grounded.

Primary windings 6 at the bobbins 61A to 61F of the inverter transformer 60A are connected to an inverter circuit (not shown) which drives the primary windings 6 at the bobbins 61A to 61F with a common drive voltage. Thus, reverse polarity AC output voltages which have their phases shifted from each other by 180 degrees are applied to the respective high voltage electrodes 65*a* and 65*a* of the CCFLs 65A and 65B, to the respective high voltage electrodes 65*a* and 65*a* of the CCFLs 65C and 65D, and to the respective high voltage electrodes 65*a* and 65*a* of the CCFLs 65E and 65F, thereby driving the three CCFL pairs 65A+65B, 65C+65D, and 65E+65F with a double voltage.

The present invention has been explained with reference to the exemplary embodiments, but the present invention is not limited in structure to the embodiments described above. For example, the inverter transformer 40 of FIG. 5 may be structured with the same constituent members as those of the inverter transformer 1 of FIG. 2 (specifically, using the bobbin provided with extensions, thus eliminating the spacer member), and the inverter transformers 50 and 60 shown respectively in FIGS. 7 and 9 may be structured with the same constituent members as those of the inverter transformer 20 of FIG. 3 (specifically, using the bobbin without extensions in combination with the spacer members, thus eliminating the bobbin provided with extensions). Also, the inverter transformers according to the exemplary embodiments include four to six bobbins, but the present invention is not limited to any specific numbers of bobbins included, and an inverter transformer according to the present invention may include more bobbins arranged in the structure disclosed above to the extent that is allowed by the outer dimension of the inverter transformer.

Also, the configurations of the bobbin extension and the spacer member are not limited to those disclosed in the embodiments described above and may be appropriately determined insofar as a sufficient withstand voltage is ensured between two adjacent secondary windings at which reversed output voltages are induced. For example, the recess 13 and the boss 14 may be appropriately configured and located, provided that the recess 13 and the boss 14 can be duly engaged with each other.

The magnetic core is made of Ni—Zn ferrite, and the spacer member is made of liquid crystal polymer of which the bobbin is made in the embodiments described above, but the present invention is not limited in terms of the material of constituent members, and any other materials may be used as long as the inverter transformer achieves prescribed performance characteristics. And, the magnetic core assembly is constituted by two "so-called E-type cores" with a plurality of legs in the embodiments described above, but may alternatively be constituted by a rectangular frame core and a plurality of bar cores (I-cores) disposed inside the rectangular frame core, or by a E-type core and an I-core.

What is claimed is:

1. An inverter transformer comprising:

a magnetic core assembly comprising a plurality of legs;

a plurality of bobbins each having a primary winding and a secondary winding wound therearound, and each having one of the plurality of legs inserted therein, wherein two sets of adjacent two bobbins of the plurality of bobbins constitute a first bobbin pair which is provided with respective secondary windings at which output voltages having their polarities reversed from each other are induced, and a second bobbin pair which is provided with respective secondary winding at which output voltages having an identical polarity are induced; and an insulation distance setting means provided between the two bobbins of the first bobbin pair so that a distance between the secondary windings disposed at each of the two bobbins of the first bobbin pair is larger than a distance between the secondary windings disposed at each of the two bobbins of the second bobbin pair.

2. An inverter transformer according to claim 1, wherein the insulation distance setting means is constituted by extensions formed integrally at one side of each bobbin, the two bobbins of the first bobbin pair are coupled to each other such that the extensions of one bobbin are engaged with a non-extended plain side of the other bobbin, and the two bobbins of the second bobbin pair are coupled to each other with their respective non-extended plain sides engaging with each other.

3. An inverter transformer according to claim 1, wherein the insulation distance setting means is constituted by a spacer member made of a non-magnetic material and formed separately from the bobbin, the two bobbins of the first bobbin pair are coupled to each other such that one side of one bobbin is engaged with one side of the spacer member and one side of the other bobbin is engaged with the other side of the spacer member, and the two bobbins of the second bobbin pair are coupled to each other with their respective sides engaging with each other.

4. An inverter transformer according to claim 1, wherein the inverter transformer is a leakage transformer.

* * * * *